US005699732A

United States Patent [19]

Sano

[11] Patent Number: 5,699,732

[45] Date of Patent: Dec. 23, 1997

[54] COMBINATION STRETCH SCREEN AND ITS PRODUCTION METHOD

[75] Inventor: Yasushi Sano, Chiba, Japan

[73] Assignee: Micro-Tec Company Ltd., Chiba, Japan

[21] Appl. No.: 519,955

[22] Filed: Aug. 28, 1995

[30] Foreign Application Priority Data

Aug. 31, 1994 [JP] Japan ..... HEI 6-230766

[51] Int. Cl.[6] ..... B41F 15/36

[52] U.S. Cl. ..... 101/127; 101/128.1

[58] Field of Search ..... 101/127, 127.1, 101/128.1, 128.21, 128.4

[56] References Cited

U.S. PATENT DOCUMENTS

| | | | |
|---|---|---|---|
| 2,299,628 | 10/1942 | Johnson et al. | 101/127.1 |
| 3,078,793 | 2/1963 | Jaffa et al. | 101/127.1 |

FOREIGN PATENT DOCUMENTS

| | | | |
|---|---|---|---|
| 2013239 | 10/1971 | Germany | 101/128.21 |
| 3034931 | 3/1982 | Germany | 101/128.1 |
| 3045241 | 7/1982 | Germany | 101/128.1 |
| 31159 | 2/1984 | Japan | 101/128.1 |

OTHER PUBLICATIONS

Micro–Tec Itochu Corporation "High Performance Precision Screen Printer".

"Screen Mask Catalogue".

*Primary Examiner*—Stephen R. Funk
*Attorney, Agent, or Firm*—Wolf, Greenfield & Sacks, P.C.

[57] ABSTRACT

This invention is aimed at achieving a high-tension combination stretch screen. First, a print screen-mesh is bonded to a supporting screen-mesh at a bonding area. Then a portion of the supporting screen-mesh overlapping the print screen-mesh is removed. Then a new supporting screen-mesh is bonded to the bonding area, and again, a portion of the supporting screen-mesh overlapping the print screen-mesh is removed. Doubly fixed supporting screen meshes thus provide sufficiently increased tension to the print screen-mesh.

18 Claims, 11 Drawing Sheets

FIG.3

| | |
|---|---|
| • SCREEN FRAME (ALUMINUM DIE CASTING) EXTERNAL DIMENSIONS | 750mm × 750mm |
| • PRINT SCREEN - MESH (STAINLESS # 325) AREA | 500mm × 500mm |

FIG.4

| | |
|---|---|
| • INITIAL TENSION OF SUPPORTING SCREEN - MESH (POLYESTER) | 0.20mm |
| • TENSION OF COMBINATION STRETCH SCREEN | 0.31mm |

FIG.5

| | |
|---|---|
| • INITIAL TENSION OF NEW SUPPORTING SCREEN - MESH (POLYESTER) | 0.20mm |
| • TENSION OF HIGH - TENSION COMBINATION STRETCH SCREEN | 0.22mm |

FIG.6

| | CONVENTIONAL PRODUCT | INVENTED PRODUCT |
|---|---|---|
| TENSION | 0.31mm | 0.22mm |
| SNAP - OFF DISTANCE | 3.0mm | 1.8mm |
| SQUEEGEE SPEED | 50mm/SECOND | 90mm/SECOND |
| ELONGATION OF PRINTED PATTERN | ABOUT 70 μm / 300mm | ABOUT 30 μm / 300mm |
| PRINTING DEFINITION | FAIR | GOOD |

COMBINATION STRETCH SCREEN AND ITS PRODUCTION METHOD

BACKGROUND OF THE INVENTION

1. Field of the Invention

This invention relates to stretched screens for screen printing to be used in the field of electronics precision imaging. More particularly, this invention relates to a method of manufacturing optimum high-tensile screen masks for high-accuracy printing.

2. Description of the Related Art

FIG. 12 shows a perspective view of a screen print machine. FIG. 13 shows a simplified front view of the screen print machine. FIG. 14 shows a simplified top view of the screen print machine. FIG. 15 shows a partially enlarged x—x cross sectional view of the screen print machine shown in FIG. 14.

The screen print machine 101 has a base unit 102. The base unit 102 mounts a table 103, a guide rail 104, and a print unit 109. The table 103 is able to move along with the guide rail 104. The table mounts a work 110 and carries the work 110 to the print unit 109. An operation box 105 is attached at the side of the base unit 102. The operation box 105 provides various kinds of operation switches 106 to an operator.

In the print unit 109, a screen 200 is held to printer base 108. The screen 200 is composed of a screen frame 1 and screen-mesh 201 having a print image. A squeegee holder 106 is attached to the printer base 108. The squeegee holder 106 holds a squeegee 111 through a squeegee base 112. The printer base 108 controls the movement of the squeegee holder 106 so that the squeegee 111 applies a required high pressure to a screen-mesh 201 and moves at a required speed along a surface of the screen-mesh 201. The high pressure is applied to a point P where the squeegee 111 and the screen-mesh 201 touch. At the point P, the screen-mesh 201 is pressed down toward the surface of the work and the image on the screen at the point P is printed to the surface of the work. Therefore, it is important for high quality printing that the screen-mesh 201 is stretched on the screen frame 1 with equally balanced high tension.

If the screen-mesh 201 is stretched with high tension, the snap-off distance, which is a distance between a screen-mesh 201 and the surface of the work, 110 can be shorter, whereby the printed image will be of a higher quality.

Hereinafter, conventional screens will be explained while referring to the figures.

There are two known types of stretch screens: (1) a direct stretch screen, and (2) a combination stretch screen. Of the two, the former is performed by directly stretching a screen over a wooden or metallic frame. Nylon, polyester, stainless steel, or other metallic mesh can be used for the screen. The latter, i.e., the combination stretch screen, involves two screen-meshes. First, a polyester screen is fixed directly on the frame as a support. Then, a metallic screen-mesh is patched on the print area. Due to the patched metallic screen-mesh, the tension of the combination stretch screen becomes lower than that of the direct stretch screen. Notwithstanding, the construction of a combination stretch screen attains higher dimensional accuracy by means of the elasticity provided by the bonded supports.

FIG. 7 is a cross sectional view of the conventional combination stretch screen.

FIGS. 8A through 8C indicate a method of making the conventional combination stretch screen using a screen frame 1, a supporting screen-mesh 2, a print screen-mesh 3, a bonding area 4 at which supporting screen-mesh 2 and print screen-mesh 3 are bonded, and a supporting screen-mesh 5 that has been removed.

FIG. 9 shows the procedure of making the conventional combination stretch screen.

At S1, supporting screen-mesh 2 is stretched over screen frame 1. At S2, print screen-mesh 3 is cut to the predetermined size and bonded to the supporting screen-mesh with adhesive. Then, a portion of the supporting screen-mesh overlapping the print screen-mesh is removed at S3.

Ever-higher dimensional accuracy has been increasingly in demand for screen printing in electronics. A highly tensile combination stretch screen is integral to desirable snap-off distances for printing.

In the conventional combination stretch screen, screen tension is increased by:

(1) strengthening the tension of the supporting screen-mesh;

(2) taking up the slack of the print screen-mesh prior to bonding;

(3) expanding the supporting screen-mesh area by way of diminishing the print screen area; and (4) first bonding the supporting screen-mesh with the print screen-mesh, and then stretching them directly over the frame.

However, the first two methods limit such characteristics as tension, elasticity, hardness, and so on for both supporting and print screen meshes. The third method is impractical because it diminishes the working print area, which invariably downgrades the value of the product. The latest trend is heading toward maximizing the print area within the screen frame. Higher tensile combination stretch screens are much sought after. The fourth method is not geared to production because the sagging or curling of screen meshes renders work all the more difficult.

The conventional combination stretch screen may have a sheet 19 inside bonding area 4 as shown in FIG. 10. Sheet 19 is bonded as a reinforcement around print screen-mesh 3, where no patterns are imaged. It is provided to prevent dimensional change during production of the screen and image distortion during printing. When print screen-mesh 3 is not centered on screen frame 1 as shown in FIG. 11, sheet 19 can also serve to keep the screen tension in balance during printing.

3. Problems to be Solved by the Invention

Stretching a screen evenly with high tension is the key to high-accuracy screen printing. Large-scale precision screen printing particularly requires highly tensile screen stretching as well as a print area as large a size as possible in relation to the screen frame. The conventional technique of combination stretching, however, has fallen short of meeting such demands satisfactorily.

The sheet may be provided to prevent dimensional change during production of the screen and image distortion during printing. Or, it can be provided to stabilize the tension balance. Therefore, the sheet itself does not serve the purpose of strengthening the tension of screens.

Accordingly, it is a primary object of this invention to solve the abovementioned problems associated with the techniques in the prior art. It aims at providing combination stretch screens with sufficient tension.

Another object of this invention is to provide combination stretch screens with a maximized print area in relation to the screen frame.

It is yet another object of this invention to provide a method of reinforcing the tension and of manufacturing highly tensile combination stretch screens.

SUMMARY OF THE INVENTION

A combination stretch screen according to this invention comprises:

(a) a screen frame;

(b) two supporting screen-meshes, each supporting screen-mesh being fixed to the screen frame wherein the two supporting screen meshes overlap each other at least partially; and (c) a print screen-mesh which is supported by the two supporting screen-meshes.

The print screen-mesh has the bonding area at each side of the print screen-mesh, and the print screen-mesh is affixed between the two supporting screen-meshes by the bonding areas.

The print screen-mesh is a metallic screen-mesh.

The metallic screen-mesh is a stainless steel screen-mesh.

A production method for a combination stretch screen according to this invention comprises the steps of:

(a) attaching a print screen-mesh to a first supporting screen-mesh; and (b) attaching a second supporting screen-mesh to the print screen-mesh such that the first and second supporting screen meshes overlap each other at least partially.

The print screen-mesh attaching step includes steps of:

(a) stretching the first supporting screen-mesh on a screen frame;

(b) affixing the print screen-mesh to the first supporting screen-mesh; and (c) removing a portion of the first supporting screen-mesh where the first supporting screen-mesh and the print screen-mesh overlap; and the second supporting screen-mesh attaching step includes steps of:

(d) stretching the second supporting screen-mesh on the screen frame;

(e) affixing the second supporting screen-mesh to the print screen-mesh; and (f) removing a portion of the second supporting screen-mesh where the second supporting screen-mesh and the print screen-mesh overlap.

A reinforcement method according to this invention comprises steps of:

(a) stretching a reinforcement screen-mesh on the screen frame of an existing stretch screen;

(b) affixing the reinforcement screen-mesh to the print screen-mesh; and (c) removing a portion of the reinforcement screen-mesh wherein the reinforcement screen-mesh and the print screen-mesh overlap.

BRIEF DESCRIPTION OF THE DRAWINGS

The invention will be further described by way of non-limiting examples with reference to the accompanying drawings, in which:

FIG. 3 shows the size of the combination stretch screen in accordance with one embodiment of the present invention;

FIG. 4 shows a comparison between the tension of a conventional combination stretch screen and that of one embodiment of the present invention;

FIG. 5 shows the tension of a high-tension combination stretch screen in accordance with one embodiment of the present invention;

FIG. 6 indicates the printing conditions for the conventional combination stretch screen and a high-tension combination stretch screen in accordance with one embodiment of the present invention;

DETAILED DESCRIPTION OF THE INVENTION

Embodiment 1

Figure 1A:
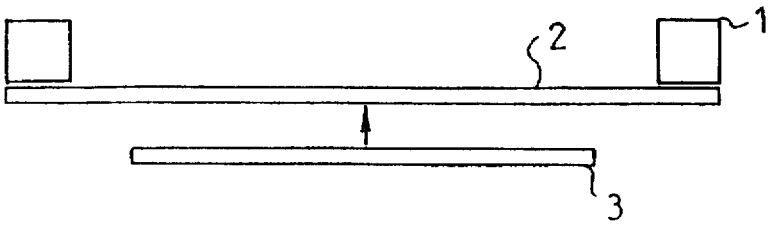
FIGS. 1A to 1F depict a method of making a high-tension combination stretch screen in accordance with one embodiment of the present invention.

FIGS. 1A through 1F depict a method of making a combination stretch screen in accordance with the present invention.

In addition to the parts numbered 1 through 5, which are the same as the related art, a supporting screen-mesh 6, and a bonding area 7 at which print screen-mesh 3 and supporting screen-mesh 6 are bonded are shown in the figures. A supporting screen-mesh 8 is the portion removed from the newly added supporting screen-mesh 6.

Figure 1B:
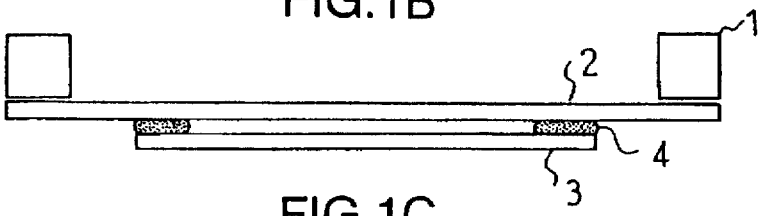
Figure 1C:
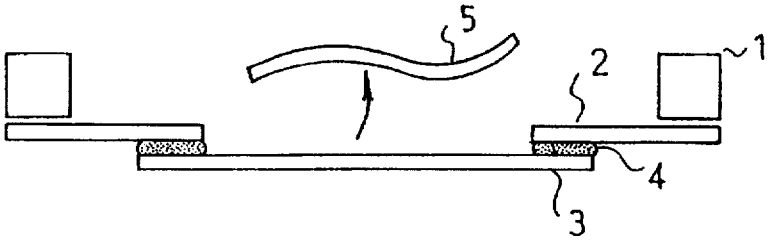
Figure 2:
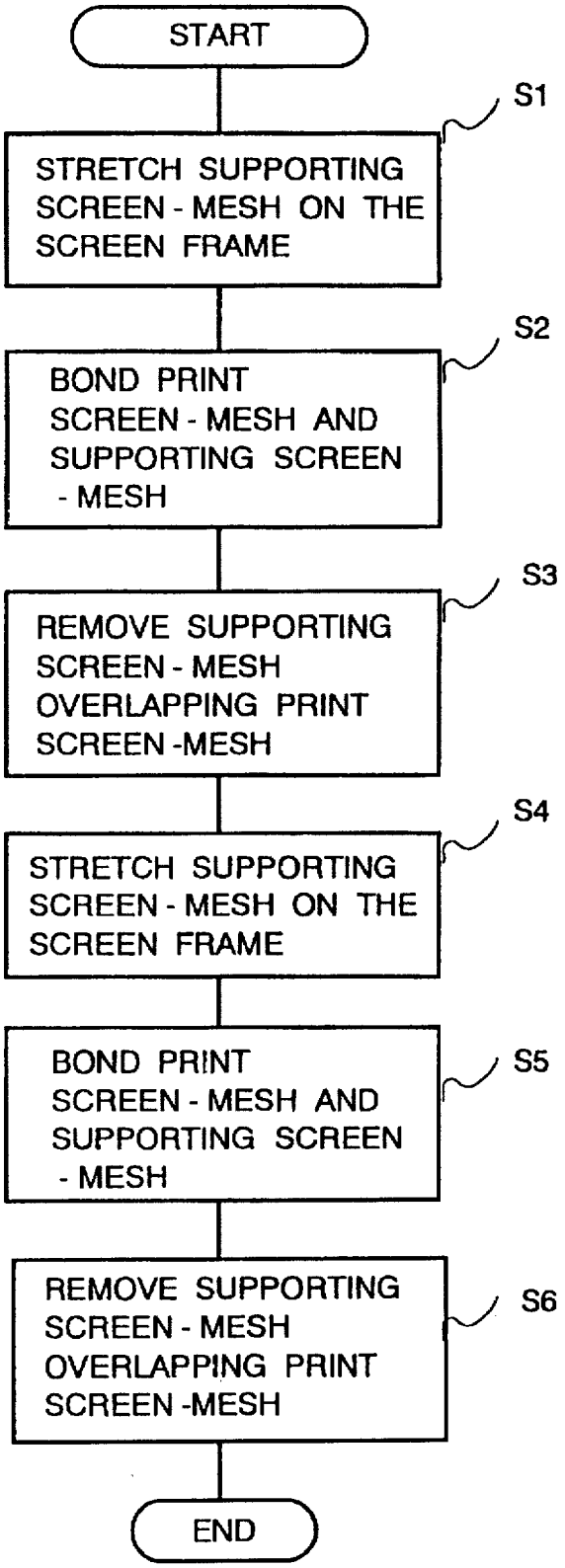
FIG. 2 shows the procedure of making a high-tension combination stretch screen in accordance with one embodiment of the present invention.
Figure 7:
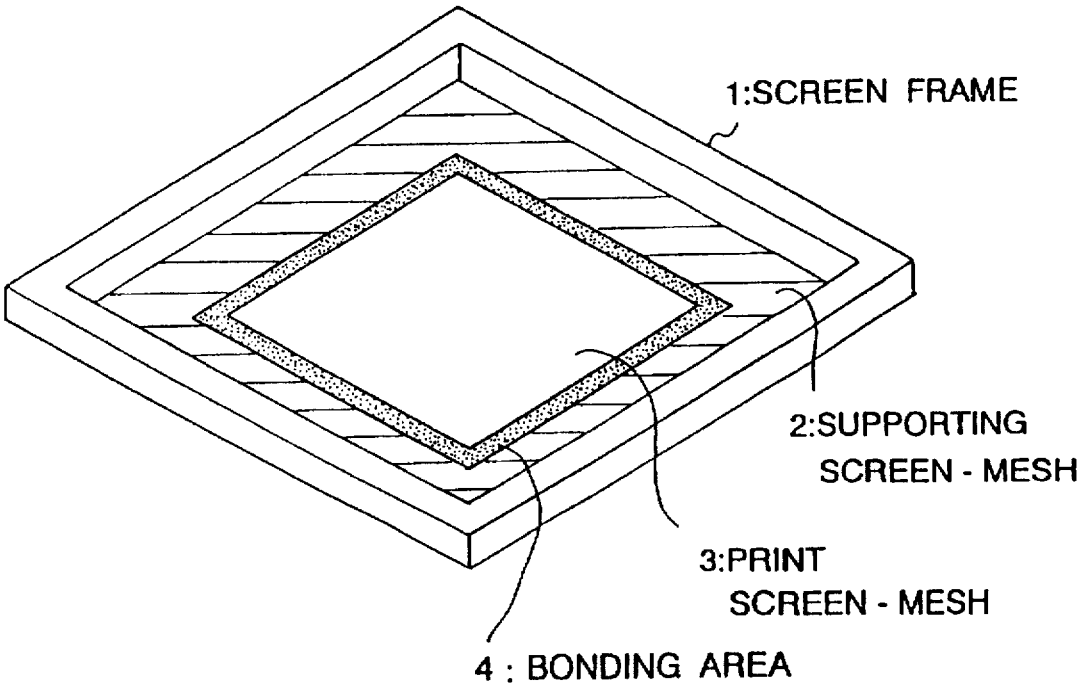
FIG.7 (PRIOR ART)
FIG. 7 is a cross sectional view of the conventional combination stretch screen.
Figure 8A:
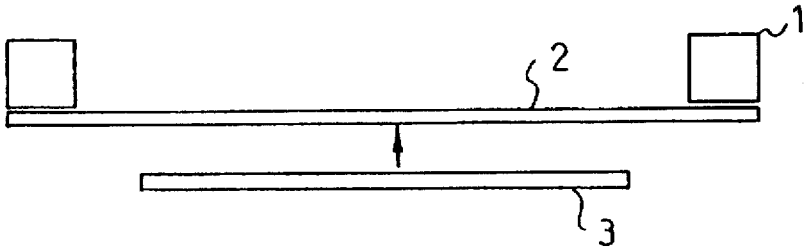
FIG.8A (PRIOR ART)
FIGS. 8A to 8C depict a conventional method of making a combination stretch screen.
Figure 8B:
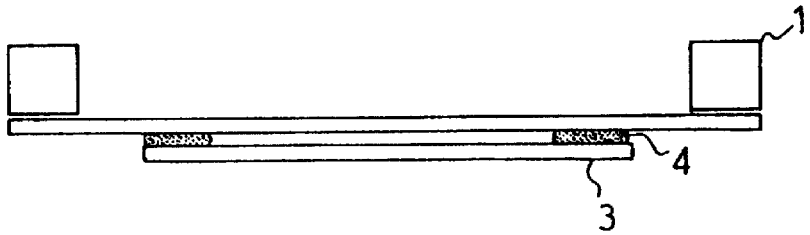
FIG.8B (PRIOR ART)
Figure 8C:
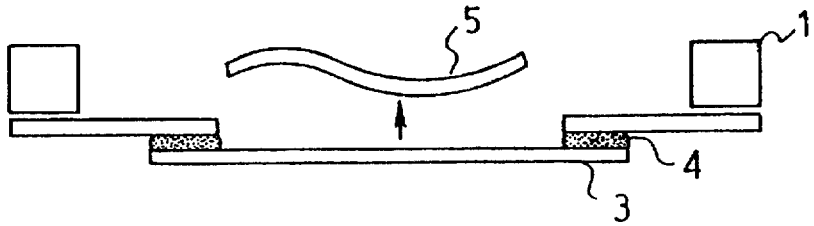
FIG.8C (PRIOR ART)
Figure 9:
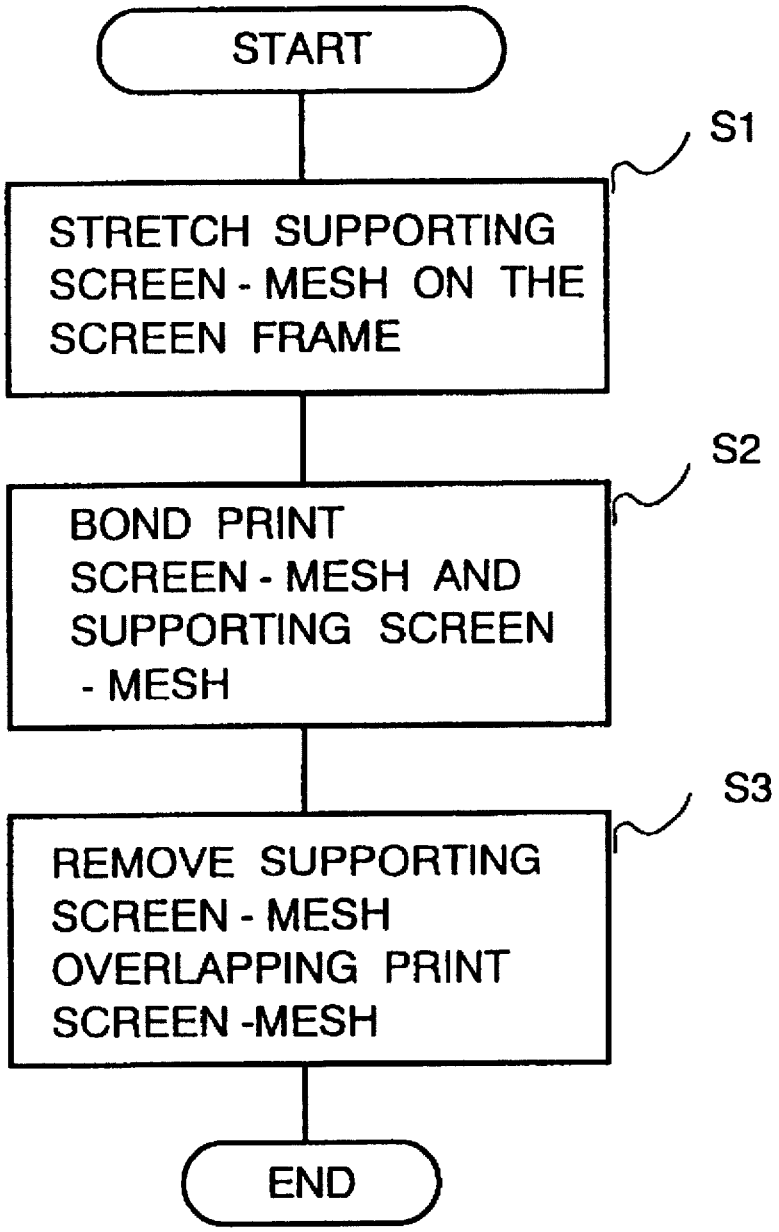
FIG.9 (PRIOR ART)
FIG. 9 indicates the procedure of making the conventional combination stretch screen.
Figure 10:
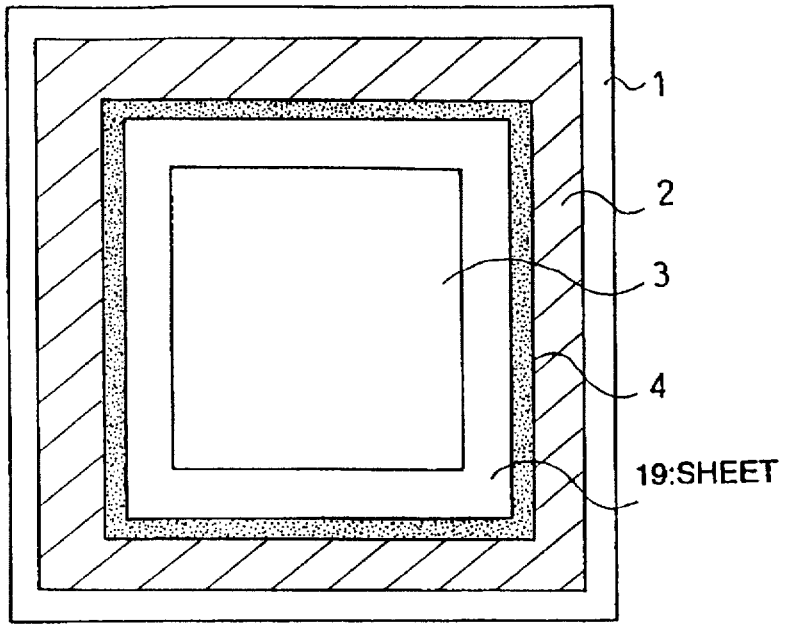
FIG.10 (PRIOR ART)
FIG. 10 shows another example of the conventional combination stretch screen.
Figure 11:
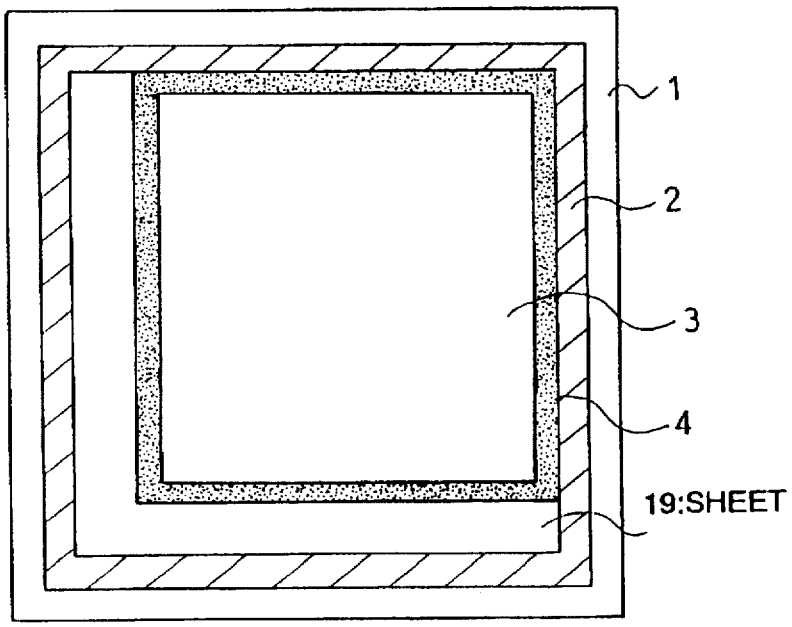
FIG.11 (PRIOR ART)
FIG. 11 shows another example of the conventional combination stretch screen.
Figure 12:
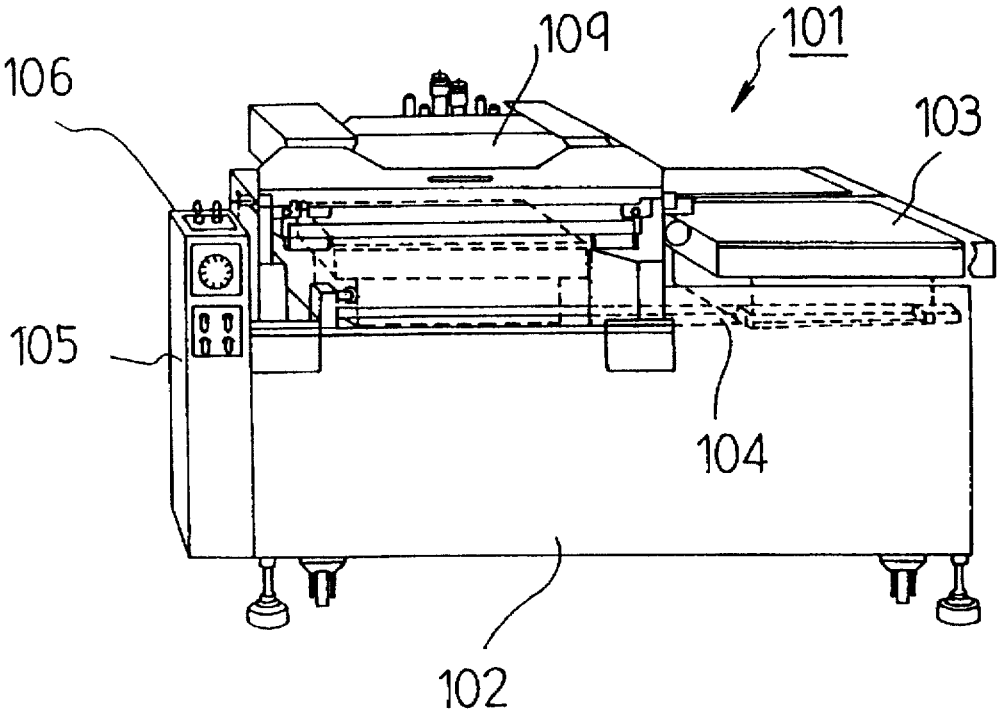
Fig.12 (PRIOR ART)
FIG. 12 shows a perspective view of a screen print machine.
Figure 13:
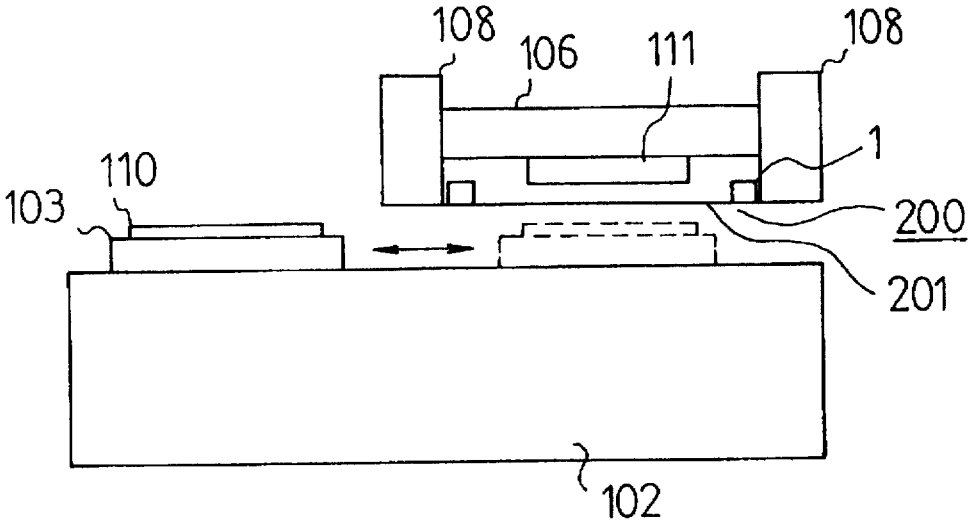
Fig.13 (PRIOR ART)
FIG. 13 shows a simplified front view of the screen print machine.
Figure 14:
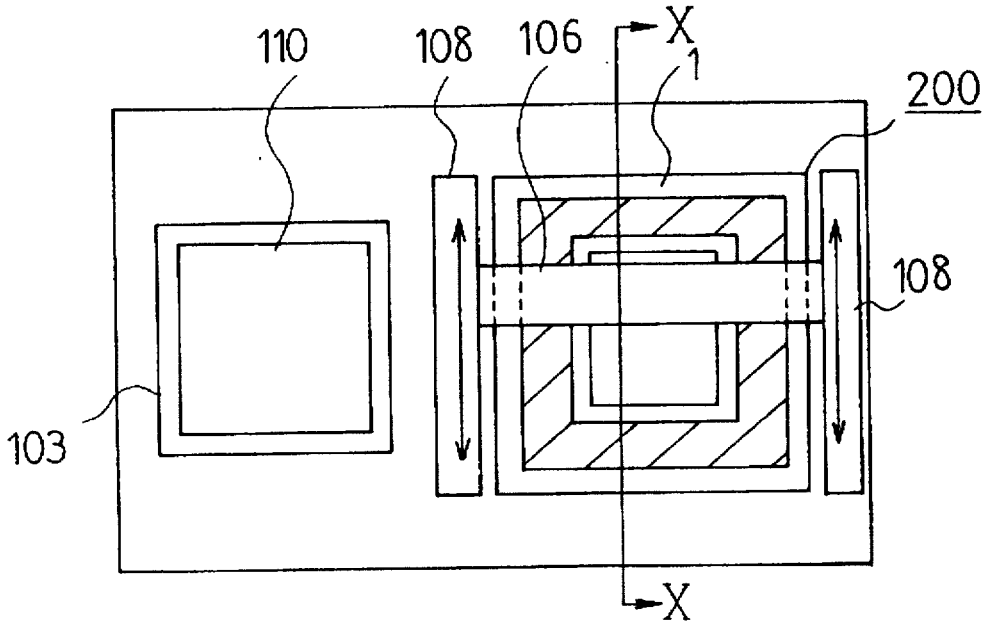
Fig.14 (PRIOR ART)
FIG. 14 shows a simplified top view of the screen print machine.
Figure 15:
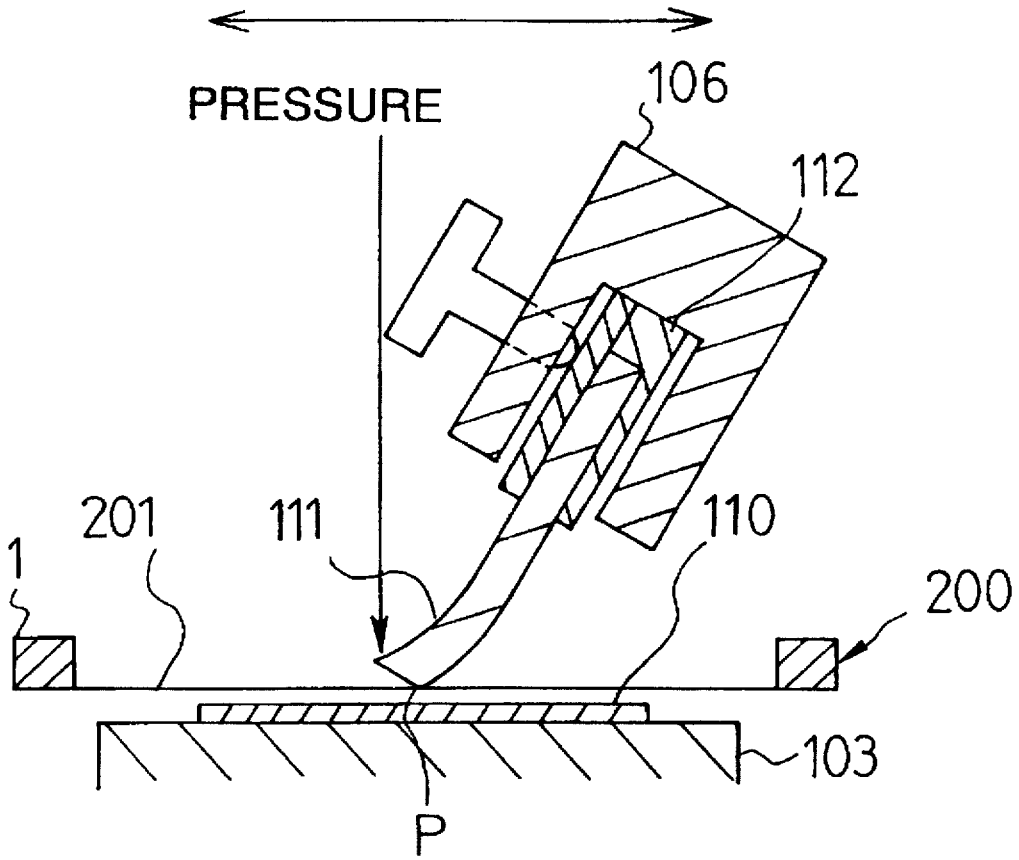
Fig.15 (PRIOR ART)
FIG. 15 shows a partially enlarged x—x cross sectional view of the screen print machine shown in FIG. 14.

FIG. 2 explains a method of making a combination stretch screen. S1 to S3 are the same as the conventional method of making combination stretch screens and correspond to FIGS. 1A to 1C, respectively. S4 to S6 correspond to steps according to Embodiment 1. At S4, new supporting screen-mesh 6 is stretched over screen frame 1. In step 5, the print screen-mesh and the new supporting screen-mesh are bonded with adhesive. Then at S6, the portion of supporting screen-mesh 8 overlapping the print screen-mesh is removed.

Figure 1D:
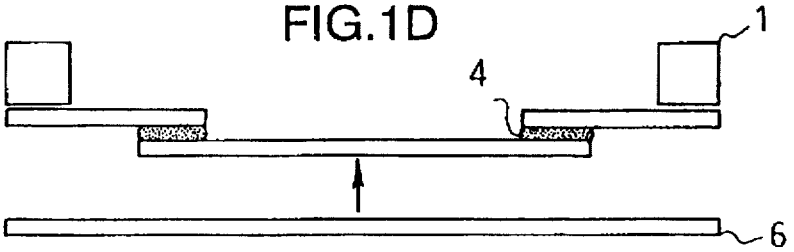
Figure 1E:
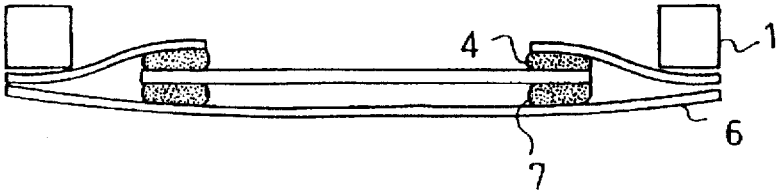
Figure 1F:
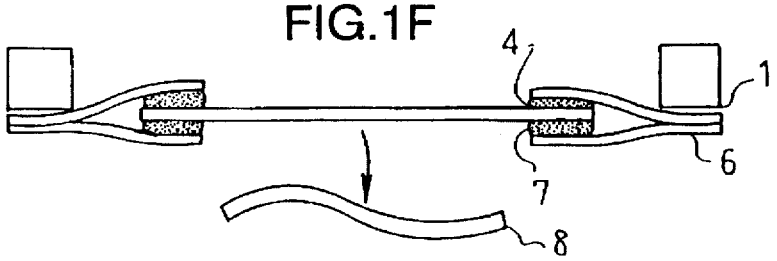

As shown in FIG. 1F, a combination stretch screen made in this way gives print screen-mesh 3 a double buttress in its surrounding by the supporting screen-meshes.

The method of FIGS. 1A though 1F is discussed in more depth below. The supporting screen-mesh is assumed to be a polyester screen and the print screen-mesh a metallic mesh screen (stainless steel for example).

As shown in FIGS. 1A to 1C, after supporting screen-mesh 2 and print screen-mesh 3 are bonded, supporting screen-mesh 5 overlapping print screen-mesh 3 is removed so as to increase the tension of print screen-mesh 3 through the tension of remaining supporting screen-mesh 2. Print screen-mesh 3 should be bonded in such a manner as to take up its slack as much as possible so that the bulk of tension of supporting screen-mesh 2 may be transferred to the print screen-mesh to realize highly-tensile combination stretching.

Then, as indicated in FIGS. 1D to 1F, the abovementioned combination stretching will be once again performed. For the first combination stretching, a certain degree of tension is applied to the print screen-mesh. Then, new supporting screen-mesh 6 is stretched and bonded to the combination bonding area, and the supporting screen-mesh is then removed. In this way, the high tension of the supporting screen-mesh stretched a second time is fully transferred to the print screen-mesh to obtain a highly tensile combination stretch screen.

As shown in FIG. 1F, it is recommended that supporting screens 2 and 6 be bonded on both sides of print screen-mesh 3. Rather than bonding supporting screen-meshes on one side of the print screen-mesh, applying tension from both sides of print screen-mesh 3 with the supporting screen-meshes permits more sufficient tension to be provided to the print screen-mesh.

FIGS. 3, 4, and 5 demonstrate the difference in tension between a conventional combination stretch screen and a high-tension combination stretch screen of the present invention.

FIG. 3 shows the size of a combination stretch screen.

FIG. 4 shows the tension of the conventional combination stretch screen of the size indicated in FIG. 3.

FIG. 5 shows the tension of a high-tension combination stretch screen obtained by stretching a new supporting screen-mesh over the conventional combination stretch screen.

Tension is expressed by the amount of deflection that results when a certain load is applied on a screen in units of mm. The higher the tension grows, the smaller the number becomes.

FIGS. 4 and 5 indicate that the tension of a high-tension combination stretch screen of this embodiment is 0.22 mm as opposed to the tension of the conventional combination stretch screen, i.e., 0.31 mm. They show that the tension of the high-tension combination stretch screen of this embodiment is higher.

FIG. 6 shows the difference in particular printing conditions between the conventional stretching screen and the high-tension combination stretch screen of this embodiment.

The higher tension of this embodiment provides several improvements: a better snapping off for small snap-off distance, higher squeegee speed, less elongation of printed patterns, and better printing definition.

This embodiment is characterized by high screen tension produced by double supporting screen-meshes in a combination stretch screen in which a metallic print screen-mesh is patched over the polyester supporting screen-mesh.

Moreover, this embodiment is characterized in that when the supporting polyester screen-mesh is doubled, after a regular single combination stretch screen is made, another polyester screen is stretched and bonded to increase the tension of the print screen-mesh. Then the portion of the polyester screen-mesh is removed, thereby making the supporting screen-mesh doubled.

The doubled supporting screen-meshes provides the following advantages.

(1) Conventionally, tension is heightened by a single supporting screen-mesh. High-tension is applied while the supporting screen-mesh is being stretched over the screen frame. The supporting screen-mesh is stretched with high-tension, and then bonded to the print screen-mesh. In this method, however, the print screen-mesh or supporting screen-mesh could be broken while the supporting screen-mesh is being removed. That is, the tension applied to the supporting screen-mesh goes off balance during removal of the supporting screen-mesh, and uneven tension being applied to the supporting or print screen mesh could result in a broken screen-mesh. However, for the double supporting screen-mesh of this embodiment, the first supporting screen-mesh is stretched without being given too much tension. When stretching the second supporting screen-mesh, tension is augmented. Because the amount of tension applied during the first stretching is not very great, the risk of breaking the supporting or print screen mesh during the removal of the first supporting screen-mesh can be overcome.

(2) In manufacturing a plurality of screens, they must be made under the same specifications with the identical tension. In manufacturing screens having the same tension, even if the tension of the first supporting screen-mesh has some dispersion, the second supporting screen-mesh can be stretched in order to change its tension. In this way, screens having the same or almost the same tension can be manufactured. By stretching the second supporting screen-mesh, tensions can be adjusted.

By adjusting tension in this way, a plurality of screens with the identical tension can be manufactured.

(3) The cost of manufacturing screens can be reduced. For a supporting screen-mesh, highly elastic polyester or nylon is used, while high dimensional accuracy screens with less elasticity, such as a stainless steel screen, are used for print screen-mesh. Stainless steel screens are pricy compared to polyester or nylon screens. Screens made by directly stretching stainless steel screens are quite costly. The image area on which the pattern imaging is performed is only a portion of the entire screen. Therefore, stainless steel screens with excellent dimensional accuracy are used for the image area whereas polyester or nylon screens with high elasticity are employed as the supporting screen.

The total manufacturing cost comes down because high-priced stainless steel screens are used only for the area requiring high accuracy, while low-priced polyester or nylon screens are employed for the surrounding parts.

When manufacturing large-scale screens, particularly, the abovementioned effect will be remarkable, thus enabling the cutting of manufacturing costs drastically.

(4) In manufacturing combination stretch screens, because polyester, nylon, or other highly elastic materials are used for the supporting screen-mesh, while less elastic stainless steel screens with high dimensional and contour accuracy, are used for the print screen-mesh, the tension can be uniformly applied to the print screen with ease. Because the supporting screen-meshes have higher elasticity, tensions for the print screen-mesh can be evenly dispersed, thereby keeping the tension from being biased unevenly.

Embodiment 2

The method of manufacturing high-tension combination stretch screens is set forth in the previous example. Embodiment 2 will discuss the method of reinforcing a conventional combination stretch screen in order to make it as tensile as in Embodiment 1. Also, the tension of a conventional combination stretch screen that has declined due to aging can be reinforced.

Tension of the combination stretch screen can be reinforced as shown in FIGS. 1D through 1F, or by following the steps S4 to S6 in FIG. 2.

By performing the procedure, the supporting screen-mesh is doubled and the tension of the print screen-mesh can be augmented.

Embodiment 3

Embodiment 1 set forth an example in which supporting screen-mesh 2 and new supporting screen-mesh 6 are made of the same material. However, it is also acceptable to use supporting screen-meshes that are made of different materials. For instance, polyester may be used for supporting screen-mesh 2 while stainless steel can be chosen for the new supporting screen-mesh.

Embodiment 4

In Embodiment 1, polyester is used for the supporting screen-mesh and stainless steel is used for the print screen-mesh. Because the supporting screen-mesh serves the purpose of adding tension in the direction of the screen frame that surrounds the print screen-mesh, it is desirable to use material with a higher elasticity than the print screen-mesh. Therefore, nylon may also be used as well as polyester.

Because the supporting screen-meshes are applied around the print screen-mesh, the working area becomes large. Thus, low-priced material is desirable. On the other hand, the material for the print screen-mesh must have little elongation in order to create pattern imaging with excellent dimensional accuracy. Therefore, metallic screen mesh is desirable.

Embodiment 5

The shape of screens is usually square or rectangular in its plane. However, polygonal screens such as circular, pentagonal, or hexagonal ones can also be doubled in their supporting structure to increase the tension.

Embodiment 6

Unlike the previous example, in which bonding areas 4 and 7 are at the same location, they can be placed at different places on opposite sides of print screen mesh 3. For instance, bonding area 7 can be set at a place that does not overlap bonding area 4 inside bonding area 4.

Function

As has been described, the combination stretch screen of the present invention can have increased tension by the application of doubled supporting screen-meshes.

The combination stretch screen of the present invention is also provided with the reinforcing screen in addition to the supporting screen-mesh so as to increase the tension.

With respect to the manufacturing method of the combination stretch screen of the present invention, because the regular manufacturing process is repeated twice, the supporting screen-mesh is doubled to increase the tension.

With respect to the reinforcement method of the combination stretch screen of the present invention, a reinforcing screen is added to the conventional or existing combination stretch screen that have lowered tensions due to prior use to increase the tension thereof.

With respect to the reinforcement method of the combination stretch screen of the present invention, a reinforcing screen is added to a direct stretch screen to increase the tension thereof.

With respect to the reinforcement method of the combination stretch screen of the present invention, a reinforcing screen is added to a used combination stretch screen and a used direct stretch screen to increase the tension thereof.

Having thus described several particular embodiments of the invention, various alterations, modifications, and improvement will readily occur to those skilled in the art. Such alterations, modifications, and improvements are intended to be part of this disclosure, and are intended to be within the spirit and scope of the invention. Accordingly, the foregoing description is by way of example only, and not intended to be limiting. The invention is limited only as defined in the following claims and the equivalents thereto.

What is claimed is:

1. A combination stretch screen, comprising:

(a) a screen frame;

(b) two supporting screen-meshes, each supporting screen-mesh being fixed to the screen frame; and (c) a print screen-mesh which is supported by the two supporting screen-meshes, wherein the two supporting screen-meshes at least partially overlap each other along a center portion of at least one edge of the print screen-mesh.

2. The combination stretch screen as claimed in claim 1, wherein the two supporting screen-meshes overlap each other along each edge of the print screen-mesh.

3. The combination stretch screen of claim 1, wherein each of the two supporting screen-meshes has a bonding portion adjacent an edge facing a center portion of the screen frame; and wherein the print screen-mesh has a bonding area therearound to affix the print screen-mesh to the bonding portions of the two supporting screen-meshes.

4. The combination stretch screen of claim 3, wherein the print screen-mesh has the bonding area at each side of the print screen-mesh, and wherein the print screen-mesh is affixed between the two supporting screen-meshes by the bonding areas.

5. The combination stretch screen of claim 4, wherein the print screen-mesh is a metallic screen-mesh.

6. The combination stretch screen of claim 5, wherein the metallic screen-mesh is a stainless steel screen-mesh.

7. The combination stretch screen of claim 5, wherein one of the two supporting screen-meshes is one of polyester screen, a nylon screen and a stainless steel screen, and wherein another of the two supporting screen-meshes is one of a polyester screen, a nylon screen and a stainless steel screen.

8. The combination stretch screen as claimed in claim 1, wherein the two supporting screen-meshes overlap entirely.

9. A production method for a combination stretch screen, comprising steps of:

(a) attaching a print screen-mesh to a first supporting screen-mesh; and (b) attaching a second supporting screen-mesh to the print screen-mesh such that the first and second supporting screen-meshes at least partially overlap each other along a center portion of at least one edge of the print screen-mesh.

10. The production method of claim 9, wherein the print screen-mesh attaching step includes steps of:

(a) stretching the first supporting screen-mesh on a screen frame;

(b) affixing the print screen-mesh to the first supporting screen-mesh; and (c) removing a portion of the first supporting screen-mesh where the first supporting screen-mesh and the print screen-mesh overlap; and wherein the second supporting screen-mesh attaching step includes steps of:

(d) stretching the second supporting screen-mesh on the screen frame;

(e) affixing the second supporting screen-mesh to the print screen-mesh; and (f) removing a portion of the second supporting screen-mesh where the second supporting screen-mesh and the print screen-mesh overlap.

11. The production method of claim 10, wherein the second supporting screen-mesh stretching step and the second supporting screen-mesh affixing step are executed simultaneously.

12. The production method of claim 10, wherein the print screen-mesh affixing step bonds the print screen-mesh at a center of the first supporting screen-mesh using a first bonding area around the print screen-mesh, and wherein the second supporting screen-mesh affixing step bonds the second supporting screen-mesh to a second bonding area around the print screen-mesh, wherein the first and second bonding areas are on opposite sides of the print screen mesh and may be overlapping.

13. The production method of claim 10, wherein the print screen-mesh affixing step bonds the print screen-mesh using a first bonding area on the print screen-mesh, wherein the second supporting screen-mesh affixing step bonds the second supporting screen-mesh using a second bonding area on the print screen-mesh which is a different area from the first bonding area.

14. A screen print machine comprising a combination stretch screen for screen printing, wherein the combination stretch screen includes, (a) a screen frame;

(b) two supporting screen-meshes, each supporting screen-mesh being fixed to the screen frame; and (c) a print screen-mesh which is supported by the two supporting screen-meshes, wherein the two supporting screen-meshes at least partially overlap each other along a center portion of at least one edge of the print screen-mesh.

15. A reinforcement method for an existing stretch screen wherein the existing stretch screen includes a screen frame, and a print screen-mesh supported by the screen frame, comprising steps of:

(a) stretching a reinforcement screen-mesh on the screen frame of the existing stretch screen;

(b) affixing the reinforcement screen-mesh to the print screen-mesh; and (c) removing a portion of the reinforcement screen-mesh where the reinforcement screen-mesh and the print screen-mesh overlap.

16. The reinforcement method of claim 15, wherein the stretching step and the affixing step are executed simultaneously.

17. The reinforcement method of claim 15, wherein the existing stretch screen is a combination stretch screen which has a supporting screen-mesh supporting the print screen-mesh, and wherein the affixing step includes a step of bonding the reinforcement screen-mesh to a bonding area of the print screen-mesh.

18. The reinforcement method of claim 17, wherein the stretching step and the affixing step are executed simultaneously.

* * * * *